US007641136B2

(12) United States Patent
Chen

(10) Patent No.: US 7,641,136 B2
(45) Date of Patent: Jan. 5, 2010

(54) CUTTER STRUCTURE OF A PAPER SHREDDER

(75) Inventor: Kent Chen, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 0 days.

(21) Appl. No.: 11/607,541

(22) Filed: Dec. 1, 2006

(65) Prior Publication Data

US 2007/0125895 A1 Jun. 7, 2007

(30) Foreign Application Priority Data

Dec. 2, 2005 (CN) ..... 2005 2 0047182 U

(51) Int. Cl.
*B02C 18/16* (2006.01)

(52) U.S. Cl. ..... 241/166; 241/100; 241/236; 241/295

(58) Field of Classification Search ..... 241/100, 241/236, 295, 166, 167
See application file for complete search history.

(56) References Cited

U.S. PATENT DOCUMENTS 4,919,345 A * 4/1990 Burlington et al. ..... 241/36
6,089,482 A * 7/2000 Chang ..... 241/236
2007/0215734 A1* 9/2007 Tsai ..... 241/236

* cited by examiner

*Primary Examiner*—Mark Rosenbaum
(74) *Attorney, Agent, or Firm*—Cozen O'Connor

(57) ABSTRACT

The present invention discloses a cutter structure of a paper shredder, which comprises a pull-rod (23), paper guide combs (24), cutter arbors (21), and at least one cutter-blade set composed of two cutter-blades (22), with said cutter-blade set being slipped on said cutter arbor (21), said pull-rod (23) being passing through the hole set on said paper guide combs (24), at least two lugs (222) being set on the bore (32) of said cutter-blade (22) and extending toward a cutter spoke (35), the height of said lug (222) along axial direction of the cutter-blade (22) is greater than the thickness of said cutter blades (22); with recesses (221) being set on cylindrical cutter arbors (21), the number of which is no less than that of said lug (222) which can be placed into said recess (221); said paper guide combs (24) being set between said cutter-blade sets; said paper guide combs (24) being slipped on said cutter arbor (21). The present utility model can omit a cutter ring used in conventional cutter structure, thus reducing the components in whole cutter structure, simplifying the fixing and increasing the radial amount of feed of the cutter-blade while decreasing the cost.

9 Claims, 4 Drawing Sheets

CUTTER STRUCTURE OF A PAPER SHREDDER

This application claims benefit of priority to Patent Application No. 200520047182.4, filed Dec. 2, 2005 in the People's Republic of China.

BACKGROUND OF THE INVENTION

1. Field of the Invention

The present invention relates to a cutting-off equipment, in particular to a cutter structure of a paper shredder.

2. Description of the Related Art

It is well known that the actuation principle of a paper shredder used for breaking paper is to slip several cutter-blades and cutter rings which are separated from each other and arranged in pairs on two rational cutter arbors, and then to drive the two parallel cutter arbors rotating in opposite direction by means of a motor and a geared system so as to cut the paper passing through it into many fine strips.

As shown in FIG. 1 to 4, a cutter structure of a paper shredder according to prior art is composed of at least one cutter-blade set, cutter arbors2l, paper guide combs 24, cutter rings 13 and pull-rods 23, and said cutter blade set is composed of two cutter-blades22. Wherein said cutter-blade sets are slipped on said cutter arbor 21 successively, said cutter rings 13 partition off said cutter-blade sets, said paper guide combs 24 are slipped on said cutter rings 13, and said pull-rods 23 are passing through the hole on said paper guide combs 24 to locate it.

Referring to FIG. 3 and FIG. 12 of a conventional cutter-blade and cutter-blade set, polygonal center hole is formed in the center of said cutter-blade for a rotational cutter arbor to pass through, and cutting-edges 30 are protruded from the periphery of cutter blade. When two cutter-blades having slipped on an rotational cutter arbor2l are merged back to back to form a cutter-blade set A, as shown, the cutting-edge of two cutter-blades forms a V-type knife-edge 33, while at the opposite rotational cutter arbor 21, a cutter ring 13 is inserted between two cutter-blades to form another cutter-blade set A' in a face to face mode. When paper to be broken is passing through two cutter arbors 21 rotating at opposite direction, the paper is cut apart by means of the relative rotation between a cutter spoke and another cutter spoke, and then the cut-off paper strips are cut down by means of the relative motion between a crooked cutting-edge 30 and the opposite cutter spoke.

In prior art, the assembling work is more tedious due to a cutter ring 13 existing in the cutter structure of a paper shredder; and the amount of broken paper is limited due to greater radial dimension of cutter ring 13, which hinders the radial feed of a cutter blade 22.

SUMMARY OF THE INVENTION

The object of the present utility model is to provide a cutter structure of a paper shredder, which is easy to assemble, low cost and has greater amount of broken paper.

To solve above problems, the present utility model includes pull-rods, paper guide combs, cutter arbors, and at least one cutter-blade set composed of two cutter-blades. Said cutter-blade set is slipped on said cutter arbor, said pull-rod is past through the hole formed on said paper guide combs, on the bore of said cutter-blade at least two lugs are set extending toward the cutter spoke, the height of which along the axial direction of the cutter-blade is greater than the thickness of said cutter-blade; at the cylindrical cutter arbor there are several recesses, the number of which is no less than that of lugs which can be placed into said recess, said paper guide combs is put between said cutter-blade sets; and said paper guide combs are slipped on said cutter arbor.

Furthermore, said lug is a hexahedron.

In addition, said lug is perpendicular to the bore of said cutter-blade.

Furthermore, said lugs located on said cutter-blade are symmetric, and the number of said lugs is 2 or 3 pieces.

Furthermore, said lugs located on said cutter-blade are asymmetric, and the number of said lugs is 2 or 3 pieces.

Comparing with the prior art, the present invention has following beneficial effects, which are: since there are lugs set in the bore of cutter-blade according to the present invention, the cutter ring present in prior cutter structure is omitted, the number of assemblies in whole cutter is decreased, thus simplifying the assembling work and dropping the cost; in addition, the radial amount of feed is increased greatly due to no the cutter ring and the amount of broken paper can be increased to 5 to 6 pieces or more.

DETAILED DESCRIPTION OF THE PREFERRED EMBODIMENTS

Figure 1:
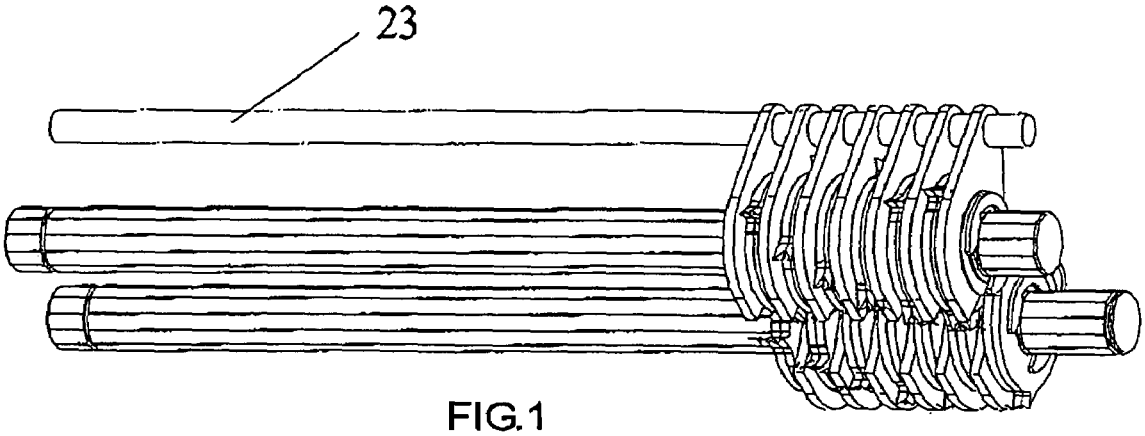
FIGS. 1 and 2 area perspective view of a cutter structure of a paper shredder according to prior art.
Figure 2:
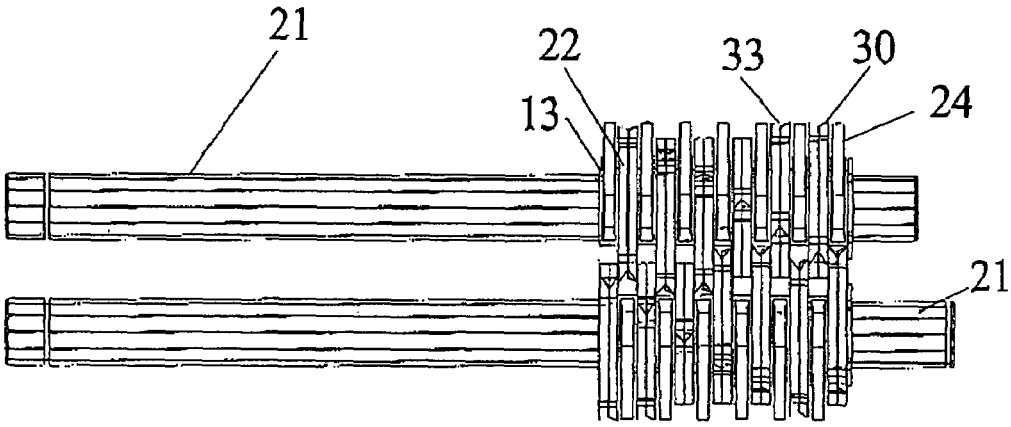
Figure 3:
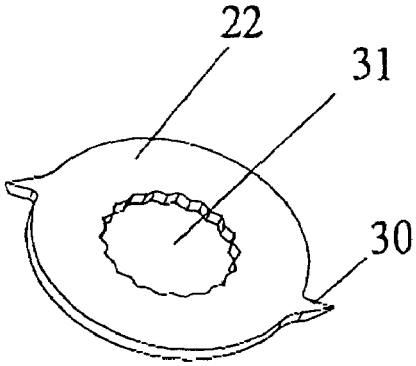
FIG. 3 is a schematic view of the cutter blade in a cutter structure of a paper shredder according to prior art.
Figure 4:
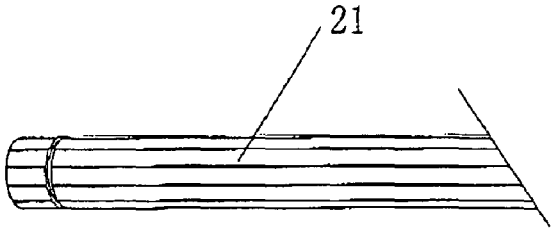
FIG. 4 is a schematic view of the cutter arbor in a cutter structure of a paper shredder according to prior art.
Figure 5:
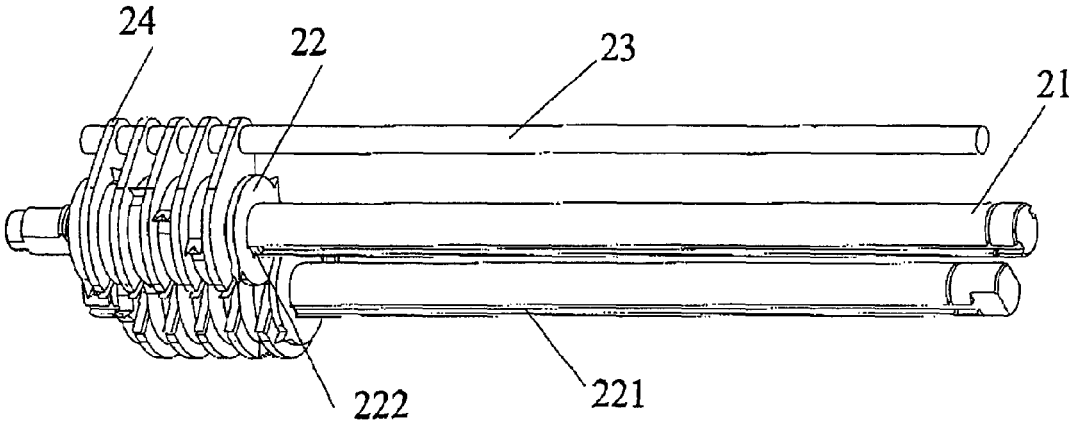
FIGS. 5 and 6 are a perspective view of the cutter structure of a paper shredder according to the present invention.
Figure 6:
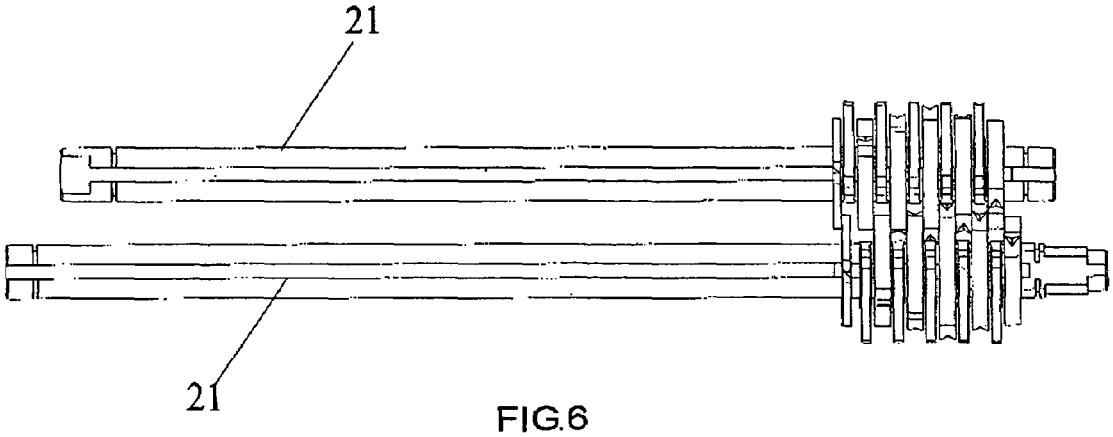

As shown in FIGS. 5 and 6, the present invention includes a pull-rod (23), a paper guide comb (24), cutter arbors (21), and at least one cutter-blade set composed of two cutter-blades (22). Said cutter-blade set is slipped on said cutter arbor (21), said pull rod (23) is passed through the hole set on said paper guide combs (24), at least two lugs (222) extending toward the cutter spoke (35) are located on the hole of said cutter-blade (22), the height of said lugs (222) along the axial direction of said cutter-blade 22 is greater than the thickness of said cutter-blade (22); on the cylindrical cutter arbor (21) there set recesses (221), the number of which is no less than that of said lug (222) which can be placed into said recess (221); said paper guide combs (24) is inserted between said cutter-blade sets; and said paper guide combs (24) is slipped on said cutter arbor (21).

Cutter-blade sets 22 and paper guide combs (24) are slipped on a cutter arbor (21) at an alternate mode, the lugs (222) on the bore (32) of a cutter-blade (22) are put into the recesses (221) of a cutter arbor (21), so as to make the cutter-blade (22) fixed on the cutter arbor (21), and the pull-rod (23) is passed through the hole of paper guide combs (24) to fix the paper guide combs (24).

The working principle of the cutter structure of a kneader according to the present invention is as follows:

At the centre of a cutter-blade there is a round centre hole (31) for rotational cutter arbor to pass through and on the periphery of a cutter-blade cutter-edges (30) are protruded. When two cutter-blade (22) passing through a rotational cutter arbor (21) are merged back to back into a cutter-blade set, i.e. the two cutter-blades take their cutter spoke opposite to the spoke (35) to merge together, the cutter edges of two blades will form a V type knife edge, and two cutter-blades on the opposite rotational cutter arbor (21) are merged back to back into another cutter-blade set, i.e. the two cutter-blades take their cutter spoke opposite to the spoke (35) to merge together; every two adjacent cutter-blade sets will be partitioned off by lugs (222) between them, and two adjacent cutter-blades which are present face to face, i.e. the two cutter-blades are merged with their cutter spoke (35), are passing through two cutter arbors (21) rotating oppositely respectively. While the paper to be broken is passing through a cutter arbor (21), the periphery of two cutter-blades are rotating oppositely, i.e. a cutter spoke and adjacent cutter spoke are rotating oppositely, so that, paper be cut off and then be cut apart through the relative motion between crooked cutter-edges (30) and their opposite cutter spoke.

Figure 7:
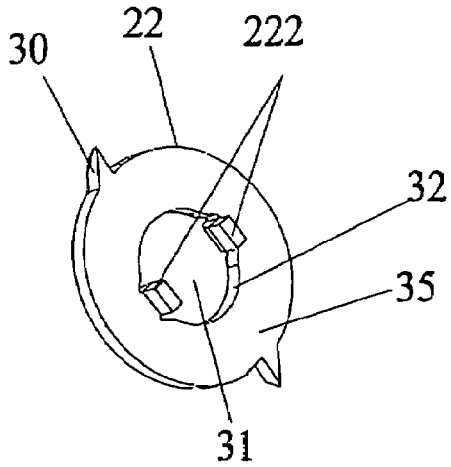
FIG. 7 is a schematic view of a cutter-blade according to the present invention, on whose bore two lugs are set symmetrically.
Figure 8:
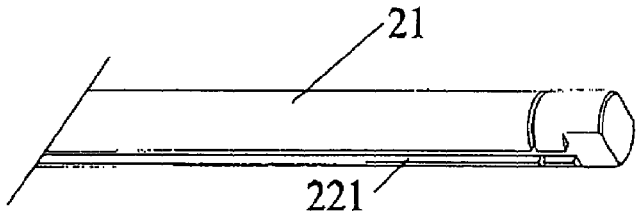
FIG. 8 is a schematic view of a cutter arbor according to the present invention, on which two recesses are set symmetrically.

As shown, FIGS. 7 and 8 are a schematic view of a cutter-blade 22 with lugs 222 and a cutter arbor 21 with recesses 221 respectively Wherein , the number of recesses 221 should not be less than that of lugs 222 , to ensure that all lugs 222 of a cutter-blade 22 can be put into corresponding recess 221.

Figure 9:
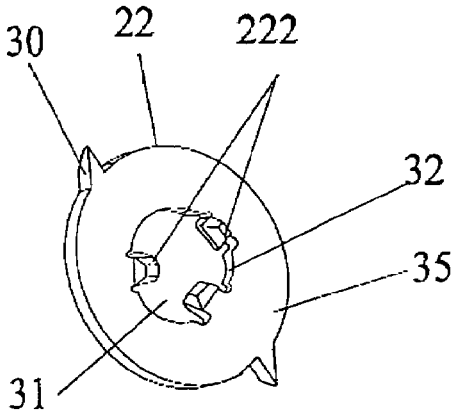
FIG. 9 is a schematic view of a cutter-blade according to the present invention, on whose bore three lugs are set symmetrically.
Figure 10:
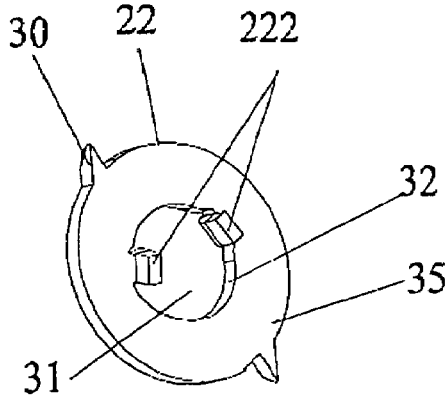
FIG. 10 is a schematic view of a cutter-blade according to the present invention, on whose bore two lugs are set asymmetrically.

As shown in FIGS. 9 and 10, the number of lugs 222 at the bore 32 of a cutter-blade 22 may be 2, 3, 4, 5 or more. Naturally, the number of recesses 221 should also be increased in accordance with lugs 222. In addition, lugs 222 located on the bore 32 of a cutter-blade 22 may be symmetric, or asymmetric, and the location of recesses 221 should also be changed correspondingly.

Further, the shape of a lug 222 is preferably a parallelepiped, which is beneficial for partitioning off adjacent cutter-blade sets on the same cutter arbor 21.

Figure 11:
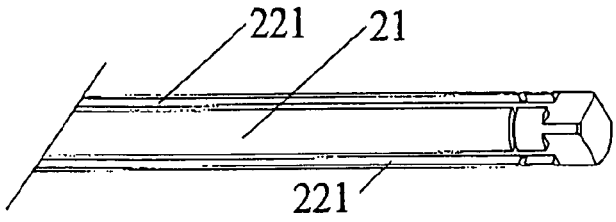
FIG. 11 is a schematic view of a cutter arbor according to the present invention, on which three recesses are set asymmetrically.
Figure 12:
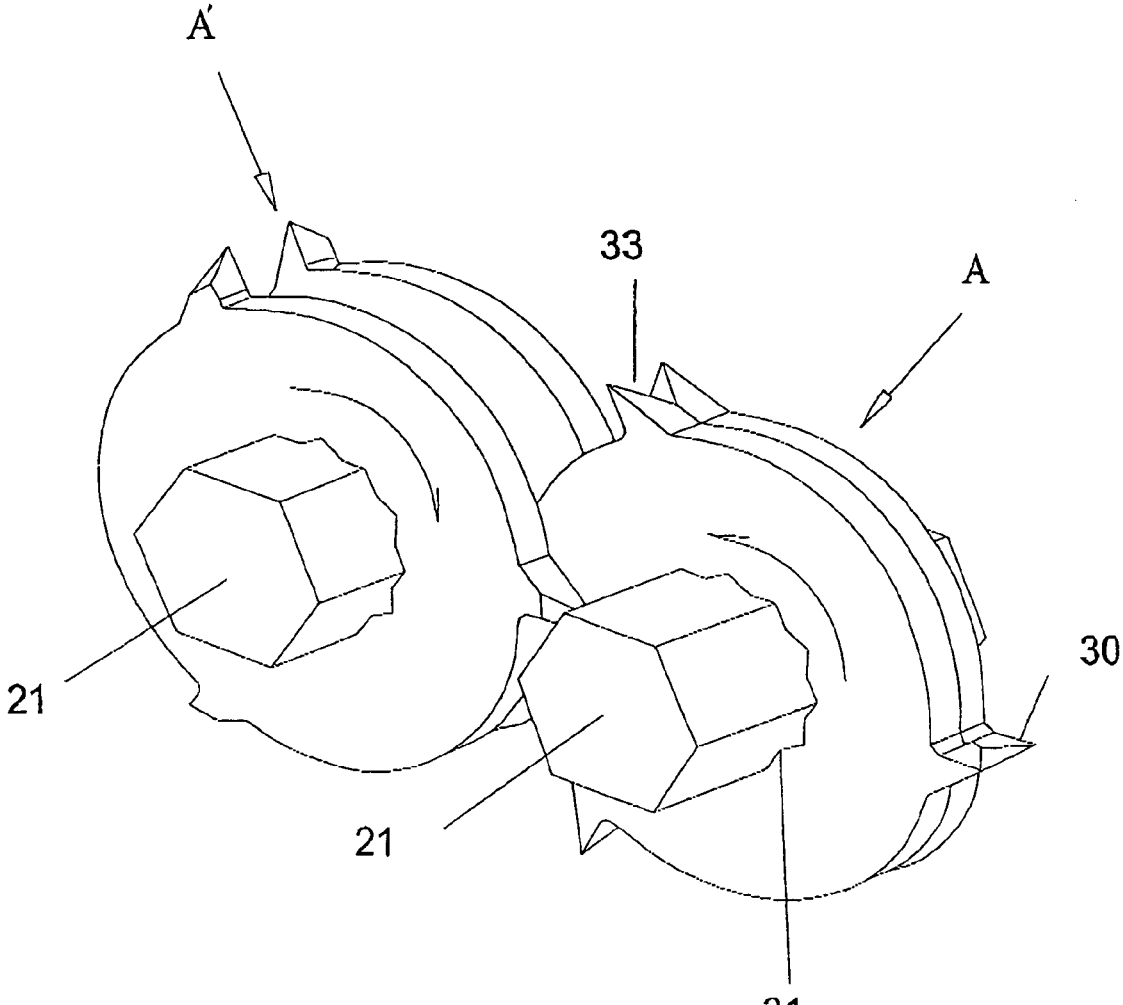
FIG. 12 is a schematic view of a conventional cutter structure of a paper shredder.

As shown in FIG. 11, it is a schematic view of a cutter arbor 21 which has three symmetric recesses 221.

What is claimed is:

1. A cutter structure of a paper shredder, comprising:

at least one pull rod;

at least one paper guide comb including a hole, said pull-rod being disposed through the hole;

at least two cutter arbors;

at least one cutter-blade set comprising two cutter-blades, each cutter-blade being disposed on a respective cutter arbor;

at least two lugs extending along a cutter spoke and set in a bore of said cutter-blades, a height of said at least two lugs along an axial direction of said cutter-blades being greater than a thickness of each said cutter-blade;

the at least two cutter arbors including a number of recesses, the number being no less than a number of said at least two lugs, said at least two lugs being disposed in said recesses;

said at least one paper guide comb disposed between said cutter-blades; and said at least one paper guide comb disposed on said at least two cutter arbors.

2. The cutter structure of a paper shredder according to claim 1, wherein said at least two lugs are hexahedrons.

3. The cutter structure of a paper shredder according to claim 2, wherein said at least two lugs are perpendicular to the bore of said cutter-blade.

4. The cutter structure of a paper shredder according to claim 3, wherein a position of said at least two lugs is symmetric on said cutter blade.

5. The cutter structure of a paper shredder according to claim 4, wherein the number of said at least two lugs is two or three.

6. The cutter structure of a paper shredder according to claim 3, wherein a position of said at least two lugs is asymmetric on said cutter blade.

7. The cutter structure of a paper shredder according to claim 6, wherein the number of said at least two lugs is two or three.

8. The cutter structure of a paper shredder according to claim 1, wherein said at least two lugs are perpendicular to the bore of said cutter-blade.

9. The cutter structure of a paper shredder according to claim 1, further comprising:

at least two cutter edges extending from a periphery of each cutter-blade, the at least two cutter edges being disposed so as to form, in combination, a V-type knife edge.

* * * * *